US009067314B2

(12) United States Patent
Frazer

(10) Patent No.: US 9,067,314 B2
(45) Date of Patent: Jun. 30, 2015

(54) DEVICE FOR LOCATING POINTS ON A SURFACE

(71) Applicant: Paul Samuel Frazer, Waunakee, WI (US)

(72) Inventor: Paul Samuel Frazer, Waunakee, WI (US)

( * ) Notice: Subject to any disclaimer, the term of this patent is extended or adjusted under 35 U.S.C. 154(b) by 211 days.

(21) Appl. No.: 13/847,239

(22) Filed: Mar. 19, 2013

(65) Prior Publication Data

US 2014/0283403 A1 Sep. 25, 2014

(51) Int. Cl.
*B25H 7/00* (2006.01)
*B25H 7/04* (2006.01)

(52) U.S. Cl.
CPC ..... *B25H 7/04* (2013.01)

(58) Field of Classification Search
CPC ..... A47G 1/16; A47G 1/1626; A47G 1/164; B25H 7/02; B25H 7/04; B25H 7/045
USPC ..... 33/669, 670, 369, 371, 374, 375, 33/671–676; 408/114 R
See application file for complete search history.

(56) References Cited

U.S. PATENT DOCUMENTS

| | | | | | |
|---|---|---|---|---|---|
| 3,628,253 | A * | 12/1971 | Shepard | 33/578 |
| 4,981,400 | A * | 1/1991 | Stover | 408/115 R |
| 5,647,139 | A * | 7/1997 | Richardson | 33/608 |
| 6,148,529 | A * | 11/2000 | Kennedy | 33/374 |
| 8,286,363 | B1 * | 10/2012 | Martinez | 33/613 |
| 8,347,518 | B1 * | 1/2013 | Martinez | 33/613 |

* cited by examiner

*Primary Examiner* — William Gilbert

(57) ABSTRACT

A device for locating points on a surface includes a base and at least two extendable arms coupled thereto. The device is configured so that when one of the arms is extended from the base, the other arm extends substantially and equidistance from the base in the opposite direction.

5 Claims, 3 Drawing Sheets

DEVICE FOR LOCATING POINTS ON A SURFACE

BACKGROUND

Hanging an object on a wall can be difficult and time consuming. Large objects such as pictures, shelves, and the like often require multiple fasteners to be installed into the wall. In order for the object to be properly positioned and level once installed, careful measurements, calculations, and leveling procedures need to be performed to properly position these fasteners on the wall. There is a need for improved techniques for locating points on a wall or other surface.

SUMMARY

In general terms, this disclosure is directed to a device for locating points on a surface. In one possible configuration and by non-limiting example, the device includes a base and at least two extendable arms coupled thereto. The device is configured so that when an end of one of the arms is extended from the base, an end of the other arm extends a substantially equal distance from the base in the opposite direction.

DETAILED DESCRIPTION

Figure 1:
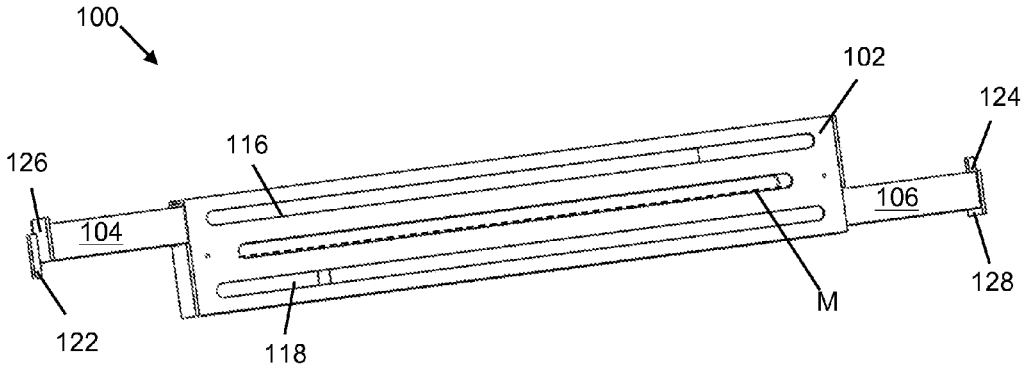
FIG. 1 is a front perspective view of an example locating device shown in a partially extended position.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Figure 2:
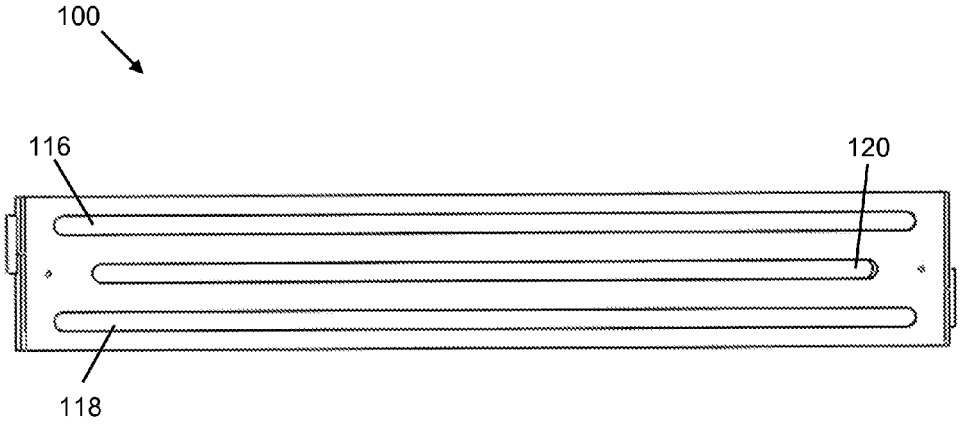
FIG. 2 is a front plan view of the locating device in retracted position shown in FIG. 1.
Figure 3:
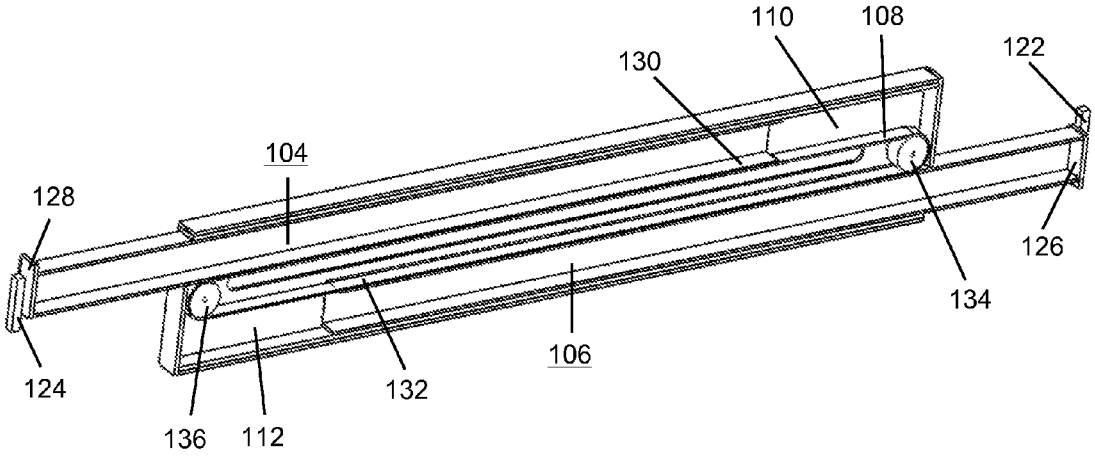
FIG. 3 is a sectional perspective view of the locating device shown in FIG. 1.

FIG. 1 is a front perspective view of an example locating device 100 in a partially extended position. FIG. 2 is a front plan view of the example locating device 100. FIG. 3 is a sectional perspective view of the example locating device 100.

In this example, the locating device 100 includes a base 102, arms 104 and 106, and arm positioning device 108. Base 102 includes channels 110 and 112. Channel 110 is shaped to receive arm 104, and channel 112 is shaped to receive arm 106.

Each arm 104 and 106 can be inserted into channels 110 and 112 where they are arranged parallel to each other lengthwise in the base 102.

In an example embodiment, the base has a length of about 24 inches, a width of about 2.5 inches, and a depth of about 0.75 inches. Arms 104 and 106 have lengths of about 24 inches and widths and depths of about 0.5 inches. Other embodiments include other sizes.

Channels 110 and 112 extend across most of the length of base 102, and are designed to house the arms while allowing the arms to slide lengthwise in the base 102. The arm 104 is separated from arm 106 by the midline cutout section 120.

There are two wheels 134 and 136 near both ends of the base in line with the center cutout section and midline M. Wheels 134 and 136 are part of an example arm positioning device. In this example, wheels 134 and 136 accommodate an inelastic band 108 that runs from wheel 134 to wheel 136 in a continuous loop. The band 108 is affixed to the arms only at two points, including point 130 near the rightmost interior side of arm 104 and point 132 near the leftmost interior side of arm 106.

Some embodiments do not include wheels 134 and 136. In one example embodiment an inelastic continuous band loops around fixed posts made from plastic, although other materials are used in other embodiments.

The arm positioning device 108 operates to provide equidistant opposing arm movement between the arms 104 and 106 when one of the arms 104 or 106 is manually slid out of the base.

Figure 4:
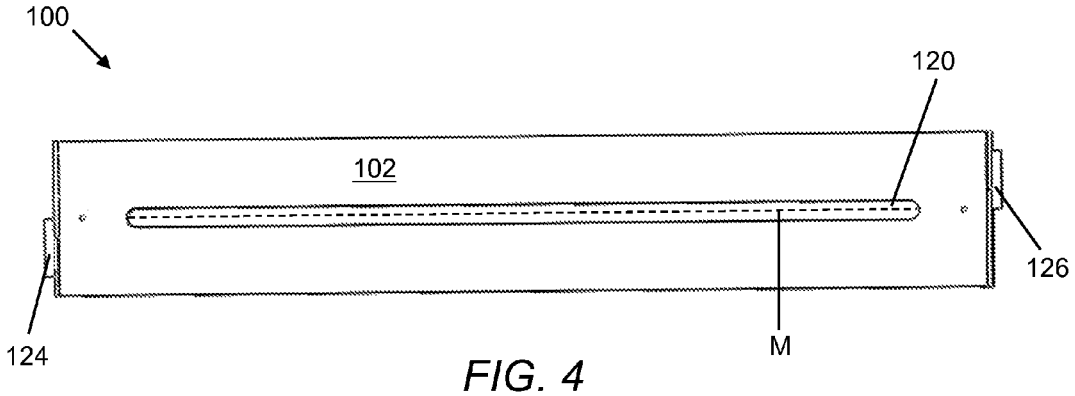
FIG. 4 is a bottom plan view of the locating device in retracted position shown in FIG. 1.

FIG. 4 is a bottom plan view of the example locating device 100 in retracted position. The base 102 includes a cutout section 120 that runs along the midline M of the base 102 lengthwise nearly the entire length, except at the two ends of the base 102.

Figure 5:
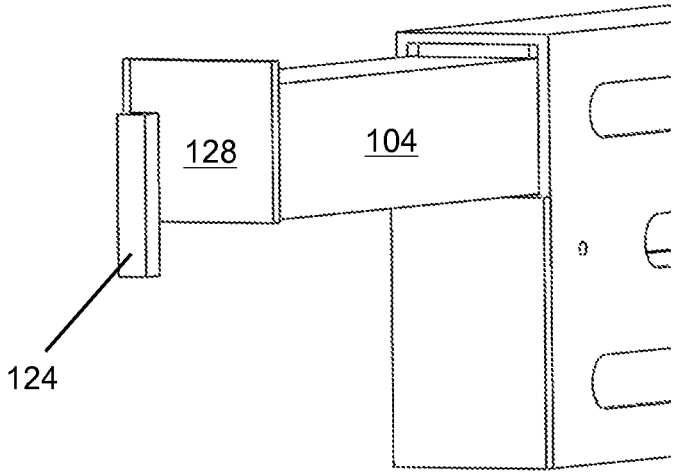
FIG. 5 is an end perspective view of a portion of the locating device shown in FIG. 1.

FIG. 5 is an end perspective view of a portion of the locating device 100.

The arm 104 terminates at its distal end in a pointer apparatus 122, and arm 106 terminates at its distal end in pointer apparatus 124. The pointer apparatuses 122 and 124 are each attached to an end cap 126 and 128 of arms 104 and 106, respectively. The pointer apparatuses 122 and 124 are aligned with midline M of the base 102.

In some embodiments, the locating device 100 includes one or more leveling devices. For example, a horizontal level device (such as a bubble or spirit level vial) is recessed and connected into a top edge of the base 102 and centered. Similarly, a vertical level device is recessed near the right lower region of base 102.

The following paragraphs describe several exemplary methods of using the locating device 100.

In one embodiment, the device 100 is used to layout and mark points on a surface. In one example, the device 100 is used for marking and layout of home décor type projects, especially projects involving wall-mounted objects. These objects include, for example, shelves, pictures, mirrors, brackets, book bins, towel bars, curtain rods, etc.

In some embodiments, the device 100 includes an indicator mark on the base at the midpoint of the device. The device 100 can be used to quickly find the center point between two boundaries on a flat surface. For example, if someone wanted to center and hang a picture on a space between an adjacent wall and a window, they would hold up the device 100 fully retracted and placed against one boundary, such as a window molding. When the knob and arm closest to the window molding is held still, the base of the device can be slid along the wall, causing the arms to extend at equal rates. The arm that is not being held in place automatically extends toward the opposing boundary while the base is being slid, and once this arm reaches and touches the adjacent wall, the movement of the device stops by virtue of the attached arm positioning mechanism. The device is now at the center of the space, and the center cutout portion allows the center point to be marked by virtue of the midpoint indicator on the base. In some embodiments, the process takes less than 5 seconds on average. Potential advantages include speed, accuracy, and the elimination of the need for measurement via tape measure or calculation of the overall midpoint.

Another method of using device 100 is for transference of distance between two attachment point hardware (keyhole is a common example of these) found on a number of decor items, such as shelves, brackets, large mirrors, etc. In some embodiments, the device 100 arms can be aligned with these attachment points by sliding out the arms and lining the two pointers up with the keyholes. Without changing the distance the arms were extended, and holding the device level (indicated by a horizontal leveling vial) the device can be used to mark the exact points between the two keyhole attachments on the wall while keeping them on a true horizontal level plane. This aids in placing mounting hardware such as screws, nails, hooks, etc. There is no calculation required to transfer the distance, and errors in measurement are reduced.

The centering and distance transfer functionalities can be combined to center, level, and mark the placement of a shelf or similar dual-attached item by finding and marking the center point of the space, then matching the pointers to the attachments, and using the previously marked center point. The device, when held level and at the center point (which is visible through the center cutout portion) allows the marking of the pointers at the correct distance, centered, and level. Mounting hardware can then be affixed to the wall accurately.

In some embodiments, the device 100 can mark multiple items on a surface at the same height and at equidistant spacing. One pointer arm will always be the same distance from the center of the device as the other arm.

When the device 100 is held level, these three points (center of base and pointers) will also always be on a level horizontal line (or vertical line if the device is turned ninety degrees). This allows for marking the placement of multiple items (pictures, hooks, etc.) at equal heights and equal spacing without calculating measurements.

In some embodiments, there are two vertical indicator lines on the tops of the two arms and centered. The purpose of these lines is to mark objects or attachment points that may be closer together than the length of the device base. Some smaller items still have dual attachment points, and by placing the device over one of these items and sliding out the arms, the vertical lines will move away from the center hole at the same rate. The lines can be matched to the item's attachments, and this distance can be marked on a surface via the midline cutout portion in the base which allows a pencil or marking tool to pass through to the wall or surface under the device at the two vertical indicator lines.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A system comprising:

a base including at least two longitudinally extending channels; a first arm and a second arm, each arm arranged in one of the channels and having a first end and a second end; an inelastic and continuous band having a first end coupled to the first arm and a second end coupled to the second arm, wherein the band is arranged and configured to extend or retract one of the first and second arms upon extension or retraction of the other of the first and second arms, wherein the band maintains the respective second ends of the first and second arms substantially equidistant from the base.

2. The system of claim 1, wherein the first and second arms are substantially parallel and when extended from the base, extend in opposite directions.

3. The system of claim 1, wherein the base includes a center cutout portion.

4. The system of claim 3, further comprising a pointer apparatus arranged adjacent the second ends of the first and second arms, the pointer apparatus configured to identify a point on a surface to be marked by a marker implement.

5. A method of marking a center point of a surface, the method comprising:

providing a locating device having a base including at least two longitudinally extending channels; a first arm and a second arm, each arm arranged in one of the channels and having a first end and a second end; an inelastic and continuous band having a first end coupled to the first arm and a second end coupled to the second arm, wherein the band is arranged and configured to extend or retract one of the first and second arms upon extension or retraction of the other of the first and second arms, wherein the band maintains the respective second ends of the first and second arms substantially equidistant from the base;

arranging the first arm of the locating device adjacent a first boundary;

moving the base of the locating device away from the boundary causing the first arm of the locating device to extend from the base and at the same time causing the second arm to extend an equal distance from the base in an opposite direction; continuing to move the base away from the boundary until the second arm is adjacent a second boundary; and marking a center point of the surface at a location defined by a center cutout portion of the base.

* * * * *